United States Patent [19]

Borchardt et al.

[11] Patent Number: 4,851,621

[45] Date of Patent: Jul. 25, 1989

[54] OPERATING HANDLE FOR AN ENCLOSED ELECTRIC SWITCH

[76] Inventors: Robert E. Borchardt, 9470 N. Maura La., Brown Deer, Wis. 53223; Eberhardt H. Schreiber, 4850 S. 39th St., Greenfield, Wis. 53221

[21] Appl. No.: 232,492

[22] Filed: Aug. 15, 1988

Related U.S. Application Data

[63] Continuation-in-part of Ser. No. 145,377, Jan. 19, 1988, abandoned.

[51] Int. Cl.[4] ..... H01H 9/20

[52] U.S. Cl. ..... 200/50 A; 200/334

[58] Field of Search ..... 200/50 A, 334

[56] References Cited

U.S. PATENT DOCUMENTS

| | | | |
|---|---|---|---|
| 2,475,338 | 7/1949 | Rowe | 200/50 A |
| 2,512,505 | 6/1950 | Rowe | 200/50 A |
| 2,806,099 | 9/1957 | Rexroad | 200/50 A |
| 2,950,363 | 8/1960 | Bachman et al. | 200/50 A |
| 3,141,934 | 9/1961 | Beaudoin et al. | 200/50 A |
| 3,171,908 | 9/1961 | Malota | 200/50 A |
| 3,179,761 | 4/1965 | Malota et al. | 200/50 A |
| 3,192,334 | 6/1965 | Dimond et al. | 200/50 A |
| 3,333,079 | 7/1967 | Michaelson, Jr. . | |
| 3,511,956 | 5/1970 | Fields . | |
| 3,657,497 | 4/1972 | Homberg et al. | 200/50 A |
| 3,767,880 | 10/1973 | Austin . | |
| 3,770,926 | 11/1973 | Wanner . | |
| 4,032,732 | 6/1977 | Homberg et al. | 200/50 A |
| 4,114,001 | 9/1978 | Corfield | 200/50 A |

FOREIGN PATENT DOCUMENTS

| | | |
|---|---|---|
| 0130727 | 1/1985 | European Pat. Off. . |
| 7931924 | 12/1978 | France . |
| 2180098 | 3/1987 | United Kingdom . |

*Primary Examiner*—A. D. Pellinen
*Assistant Examiner*—Morris Ginsburg

[57] ABSTRACT

An electric switch operating mechanism has a base fastened over an aperture in the cabinet enclosing the switch. A driving member extends into a cup-like member and the ends of both members extend through the base and the cabinet aperture. The ends of the driving member and retainer cup have apertures therein which receive an end of the control shaft for the switch. The cup-like member is rotatable with respect to the driving member to captivate a retaining pin on the end of the control shaft. A handle with a locking plate is connected to the driving member and abuts the base. The handle can be rotated to rotate the control shaft. The locking plate can engage the base and the retainer cup to lock the operating mechanism in different positions. The mechanism in addition to operating the switch also provides an interlock function preventing the cabinet from being opened.

26 Claims, 6 Drawing Sheets

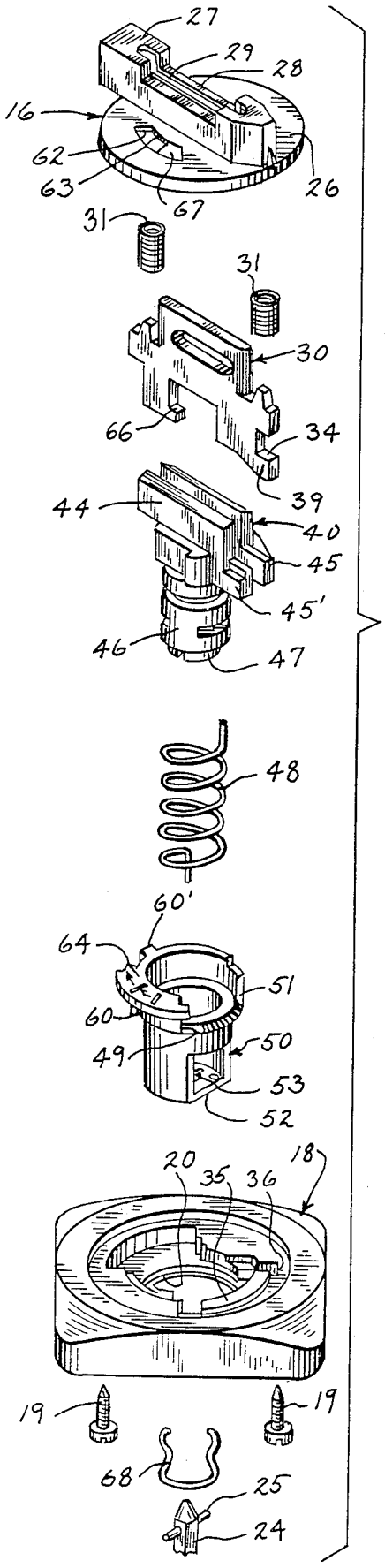
FIG. 2
FIG. 4
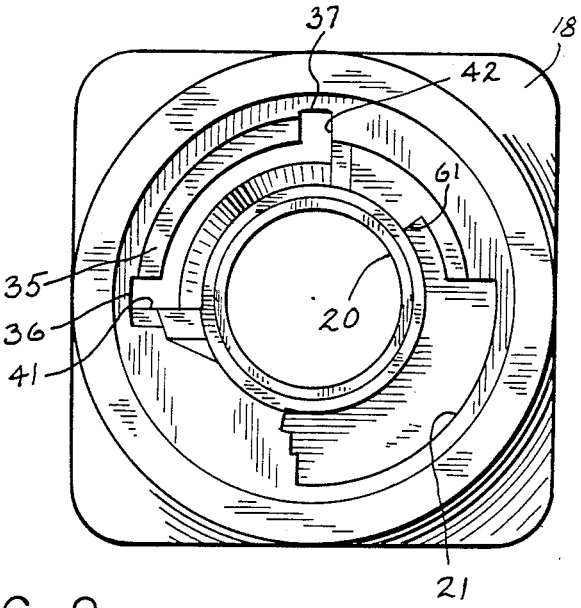
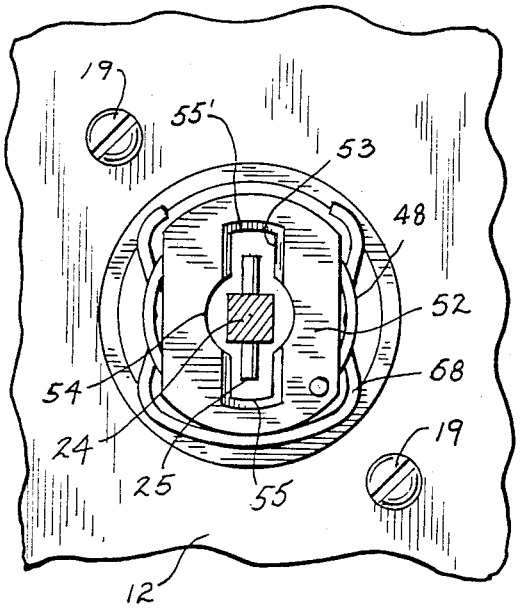
FIG. 5

OPERATING HANDLE FOR AN ENCLOSED ELECTRIC SWITCH

This is a continuation-in-part of U.S. patent application Ser. No. 07/145,377 filed Jan. 19, 1988.

BACKGROUND OF THE INVENTION

The present invention relates to handles for operating electrical switching apparatus that is housed in an enclosure.

Apparatus for switching electricity is typically placed in a protective enclosure so that the operator is not exposed to a shock hazard. The apparatus is operated by a handle which is mounted on the door or other portion of the enclosure. One type of such handle is shown in U.S. Pat. No. 3,657,497. The handle also provides a means for locking it in either the on or off position.

In addition to operating the switching apparatus, the handle often interlocks the enclosure door so that it cannot be opened when the switching apparatus is in the on position. Some previous handles provided a way to defeat the interlock by using a tool.

Depending upon the type of electrical device or circuit being controlled by the switching apparatus, different functions may have to be incorporated in the handle. For example, the handle may have to be capable of being locked in only the off position, or both the on and off positions. Furthermore, it may be desirable to allow the interlock feature to be defeated so that the cabinet can be opened when the handle is in the on position. In certain applications this interlock defeating capability should be disabled when the handle is locked in the on position.

Heretofore, different models of handles incorporated different combinations of these functions. A specific model had to be selected depending upon the nature of the application. After installation of the handle, if the device or circuit controlled by its switching apparatus changed, the functions of the handle could not be altered without its total replacement. It is therefore desirable to provide a common type of handle which can be easily modified to enable different combinations of these functions.

SUMMARY OF THE INVENTION

An electric switch apparatus is enclosed in a housing having a door with an aperture therethrough. The apparatus has a control shaft which is rotatable to operate it. The shaft is aligned with the aperture when the door is closed and has an end portion with a transverse pin. An operating handle assembly is mounted on the door over the aperture to engage releasably the end portion of the shaft when the door is closed.

The handle assembly includes a base fastened to the door with an aperture aligned with the aperture in the door. A driving member rotatably extends through the base aperture and engages the end portion of the shaft. A retaining cup extends around the driving member and is rotatable about the driving member between different orientations. At a first orientation the retaining cup holds the shaft in engagement with the driving member and at a second orientation the shaft can be disengaged from the driving member. The assembly also includes a locking plate which slides in a groove of the driving member to releasably engage a notch in the base to prevent rotation of the driving member.

An object of the present invention is to provide a handle for operating an electric switch apparatus in an enclosure.

Another object is to provide an interlock function in the handle by which the enclosure cannot be opened except when the handle places the switch apparatus in a given position.

A further object of the present invention is to incorporate a mechanism in the handle for defeating the interlock so that the enclosure can be opened with the switch apparatus in other than the given position.

Yet another object is to provide a handle with an interlock that can be enabled to prevent the enclosure from being opened even when the switch apparatus is locked in the off position.

A still further object of the present invention is to provide a handle which can be locked in the on position of the switch apparatus.

Another object of the present invention is selectably to permit or inhibit the door being opened when the handle is locked in the on position.

An object of the preferred embodiment of the present invention is to provide a handle which can be modified by the user to enable different ones of these objects.

BRIEF DESCRIPTION OF THE DRAWINGS

FIG. 2 is an exploded illustration of the parts of the operating handle assembly;

FIG. 4 is a plane view of the base of the operating handle assembly;

FIG. 5 and 6 are plane views of the operating handle assembly in two operating positions as seen from inside the enclosure;

DETAILED DESCRIPTION OF THE PRESENT INVENTION

Figure 1:
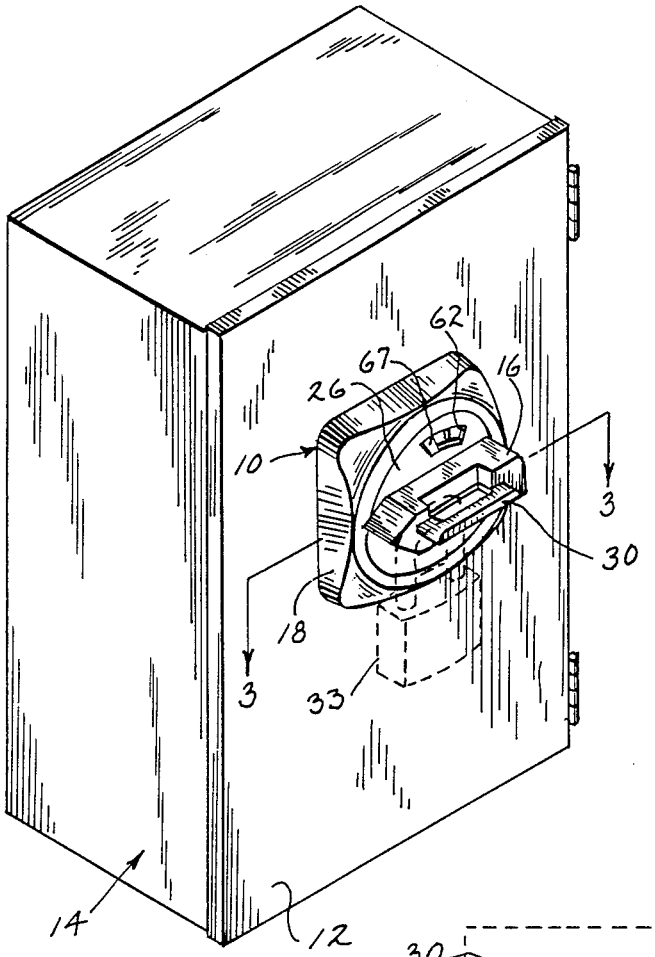
FIG. 1 is a perspective view of a switch enclosure with the present operating handle assembly mounted thereon.

As shown in FIG. 1, an operating handle assembly 10, according to the present invention, is mounted on the door 12 of an electrical cabinet 14 and is made of electrically insulating material, such as plastic. The cabinet encloses a conventional electric disconnect switch for switching three-phase electricity to an electric load, for example. The handle assembly couples to a control shaft for operating the switch and also acts as an interlock preventing the door 12 from being opened when the switch and the handle assembly 10 are in certain positions.

Figure 3:
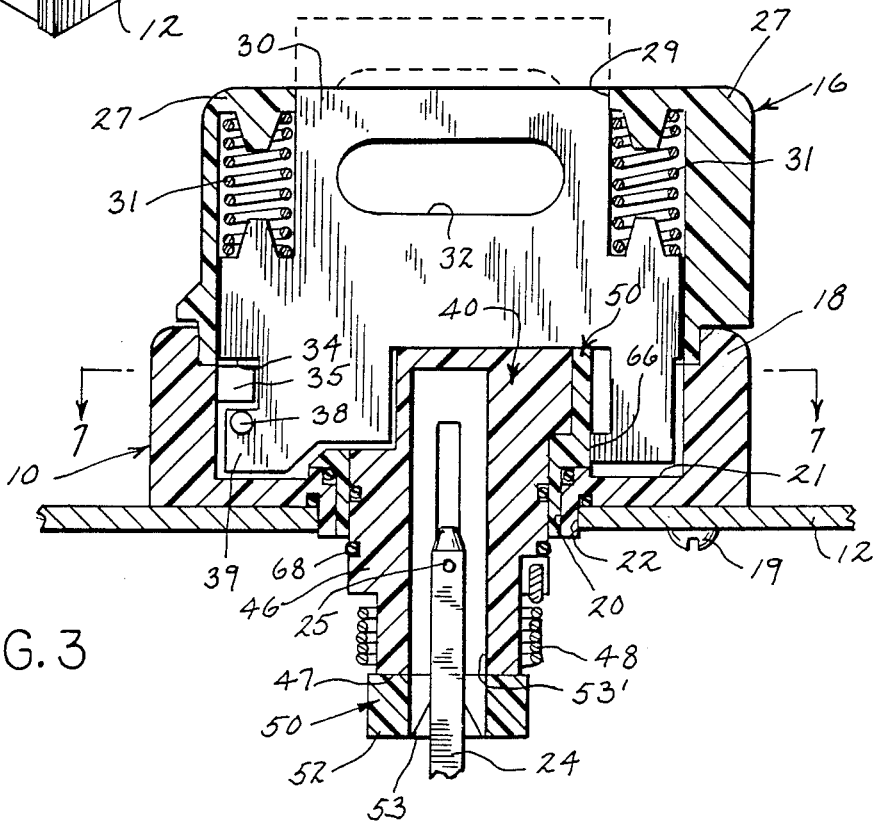
FIG. 3 is a cross section view of the operating handle assembly taken along line 3—3 of FIG. 1.

Referring to FIGS. 2, 3 and 4, the handle assembly 10 includes a base 18 which is attached to the door 12 by two screws 19. The base 18 has a centrally located aperture 20 extending therethrough. As best shown in FIG. 4, the inner wall of the aperture 20 has a number of recesses and steps, such as recess 21. These recesses and steps provide guide surfaces and stops for supporting and controlling the movement of the other handle assembly components.

When the handle assembly 10 is mounted on the door 12, the aperture 20 in the base 18 is aligned with an aperture 22 in the door 12. The aperture 22 in the door 12 is aligned with a square control shaft 24 of the electrical disconnect switch when the door is closed. The rotation of the control shaft 24 operates the switch. The end portion of the shaft 24 that is shown in the Figures has a pin 25 extending transversely therethrough. The pin 25 aids in applying rotational force to the shaft 24, and as will be described, engages the handle assembly 10 to provide a door interlock function.

A handle 16 of the assembly 10 has a disk shaped portion 26 with a generally rectangular projection 27 extending outwardly therefrom. The rectangular projection 27 is sized to be grasped between the thumb and fingers of an operator's hand to enable the operator to rotate the handle 16. The outer surface of the rectangular projection has a recess 28 with a rectangular aperture 29 therethrough. A locking plate 30 extends edgewise through the aperture 29 in the handle 16. Two compression springs 31 are located between the locking plate 30 and the handle 16 in recesses in the underside of the rectangular projection 27. The locking plate 30 has a notch 34 which receives an arcuate projection 35 of the base 18. The lower portion 39 of the locking plate 30 beneath the notch 34 has an ear 38 extending outwardly from the plate.

Two axial grooves 36 and 37 are located in the base 18 at the ends of the projection 35. The first groove 36 is wider than the second groove 37. The width of both grooves 36 and 37 is greater than the thickness of the locking plate 30. The combined thickness of the locking plate 30 and the ear 38 is less than the width of the first groove 36 but greater than the width of the second groove 37 (refer to FIGS. 8 and 10 where the locking plate 30 is aligned with grooves 36 and 37 respectively). As the handle 16 is rotated, the lower portion 39 of the locking plate abuts the outer walls 41 and 42 of the two base grooves 36 and 37. This limits the rotation of the handle 16 to a 90 degree arc between the two grooves.

The locking plate 30 and handle 16 engage a switch shaft driving member 40. Clips molded on the underside of the handle 16 (not shown) clamp around the driving member 40 to couple these elements together. The driving member has a slotted portion 44 for guiding and retaining the locking plate 30. A cylindrical portion 46 of the driving member 40 extends into a cylindrical switch shaft retainer cup 50. A pair of tabs 45 and 45' extend from the slotted portion 44 through a cut out 51 in the rim 64 of the retainer cup 50. A torsion spring 48 has its ends inserted in apertures in the driving member 40 and the retainer cup 50. The torsion spring 48 biases the retainer cup so that end 49 of cut out 51 is normally forced against one of the driving member tabs 45'.

Figure 6:
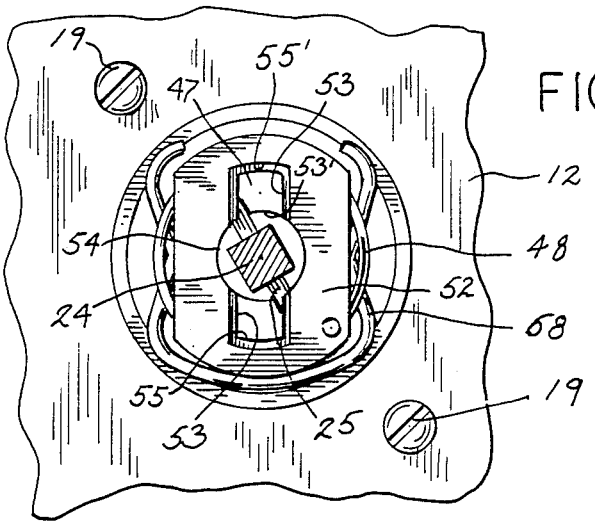

As shown in FIGS. 5 and 6, the end 47 of the driving member 40 and the end 52 of the retainer cup 50 have substantially identical apertures 53 and 53' therein. Each one of the apertures 53 and 53' is elongated with a wider central circular opening 54. The diameter of the circular opening 54 is sufficient to receive the square control shaft 24. The ends of the shaft pin 25 are received in the end portions 55 and 55' of each aperture 53 and 53'. The walls of the aperture 53 in the retainer cup 50 are tapered to accommodate and guide the end portion of the control shaft 24 as the cabinet door 12 opens and closes. The end of the control shaft 24 is also tapered for this purpose (see FIGS. 2 and 3). The driving member 40 and the retainer cup 50 can rotate with respect to each other. When the tabs 45 and 45' on the driving member 40 are centered in the retainer cup cut out 51, the apertures 53 and 53' in both elements are substantially aligned as shown in FIG. 5. In this orientation of the apertures, the end of the control shaft can enter or exit the handle assembly 10. When the driving member tabs 45 and 45' are in either extreme position within the cut out 51, the apertures 53 and 53' are misaligned, as shown in FIG. 6, capturing the end of the control shaft within the driving member 40. The torsion spring 48 rotationally biases the retainer cup 50 so that the apertures 53 and 53' are normally misaligned, retaining the control shaft 24.

The combination of the handle 16, locking plate 30, driving member 40, retainer cup 50, and the associated springs 31 and 48 nest within the central aperture 20 in base 18 as shown in FIG. 3. When the components are assembled, the circumferential surfaces of the driving member 40 and the retainer cup 50 engage the stops on the interior surface of the base aperture 20 which restrict their rotational movement. A portion of the retainer cup 50 and driving member 40 extend through the base 18 and have a retaining clip 68 around them to hold the handle assembly 10 together.

Referring to FIGS. 1 and 3, when the door 12 of the switch cabinet 14 is closed, the end of the control shaft 24 is received within the end aperture 53' of the driving member 40. Rotation of the handle 16 rotates the driving member and thereby the control shaft 24. The switch apparatus is in the open, or off, state when the rectangular projection 27 of the handle 16 is in the horizontal position in FIG. 1. Rotating the handle 16 ninety degrees clockwise, until the rectangular projection 27 is vertical, places the switch in the closed, or on, state.

Figure 7:
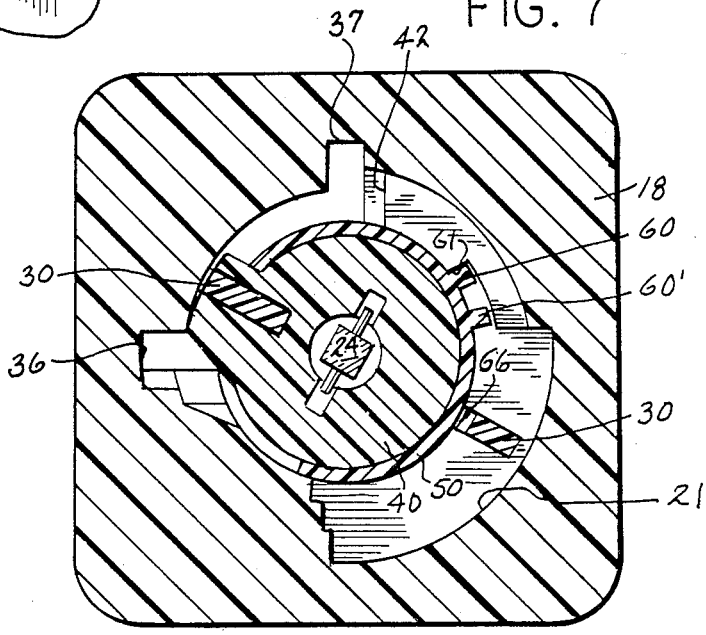
FIGS. 7–11 are cross-sectional views of different positions of the operating handle assembly taken along line 7—7 of FIG. 3.

When the handle 16 is slightly above the horizontal position, the switch is also in the off state. In this position, as shown in cross-section in FIG. 7, a longitudinal ridge 60 on the exterior of the cylindrical retainer cup 50 abuts an end wall 61 of the recess 21 in base 16, preventing further counterclockwise rotation of the cup. The retainer cup 50 is held abutting the end wall 61 position by torsion spring 48. In this position, the elongated apertures 53 and 53' in the ends of the driving member 40 and retainer cup 50 are misaligned, as shown in FIG. 6. As a result of this misalignment, the control shaft 24 of the disconnect switch is captured in the handle assembly 10 and the cabinet door 12 cannot be opened.

Figure 8:
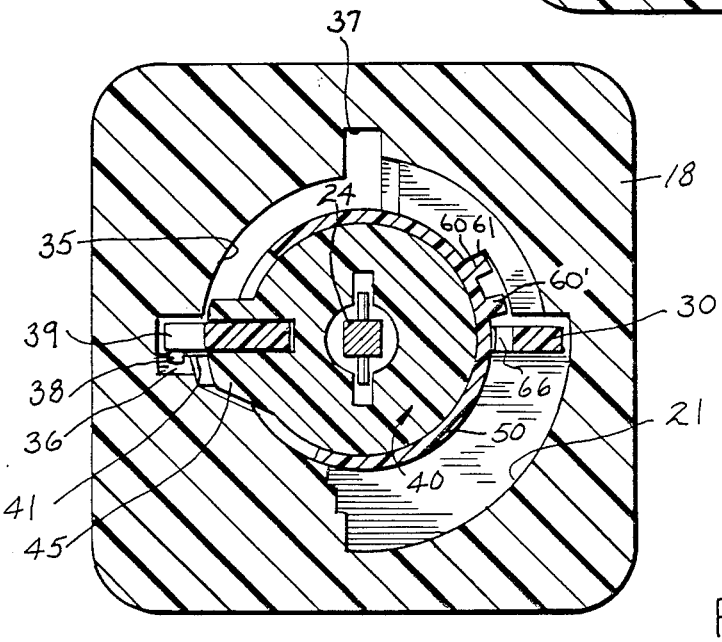

Further counterclockwise rotation of the handle 16 into the horizontal position causes the driving member 40 to rotate within the retainer cup 50 against the force of torsion spring 48. When the handle 16 is manually held in this horizontal position, the elongated apertures 53 and 53' are aligned as shown in FIG. 5 so that the control shaft 24 can be pulled out of the handle assembly 10 as the door 12 is opened, or can be received in the handle assembly as the door is closed. In this orientation, the locking plate 30 is against the wall 41 of the first groove 36 and the locking plate 30 is aligned with the groove, as shown in FIG. 8. The width of the first groove is sufficient to allow the lower portion 39 and the ear 38 of the locking plate to pass therethrough. This enables the locking plate 30 to be pulled outward from the handle, against the force of springs 31, by grasping the portion of the locking plate that extends into the handle recess 28. This position of the locking plate is illustrated by phantom lines in FIG. 3. In this outward state, the lower portion 39 of the locking plate 30 is between the base projection 35 and groove wall 41 thereby preventing rotation of the handle 16. In addition, the two longitudinal ridges 60 and 60' on the retainer cup 50 are trapped between end 61 of the base recess 21 and a tab 66 on the locking plate 30. In this outward position of the locking plate 30, a padlock 33 (FIG. 1) can be inserted in the exposed locking plate aperture 32 to lock the handle 16 in the off position.

Figure 9:
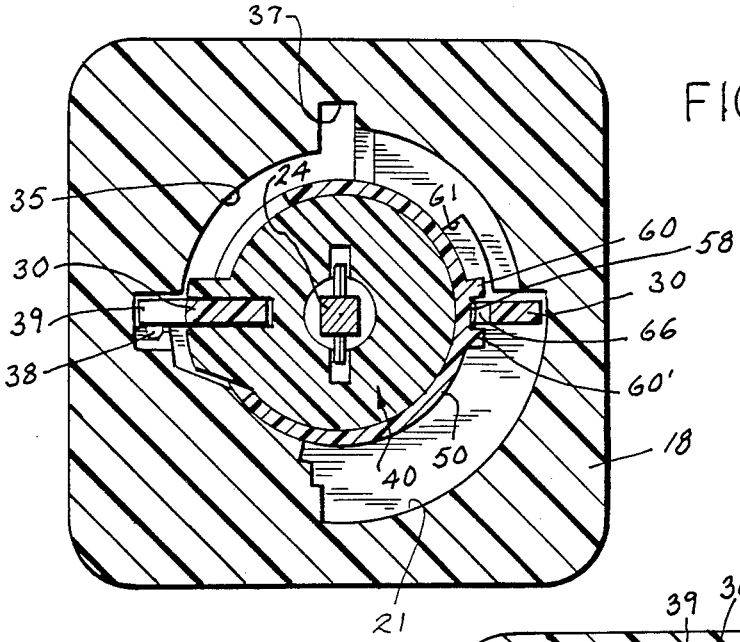

If it is desired to lock the switch in the off state and prevent the cabinet door 12 from being opened, a different locking procedure is employed. With the handle 16 manually held in the horizontal orientation shown in FIG. 1, a screwdriver or similar tool is inserted into a window 63 in the disc portion 26 of handle 16. The portion of the retainer cup rim 64 visible through the window 63 has a notch to receive the blade of the screwdriver. The screwdriver engages the exposed notch in order to rotate the retainer cup 50 clockwise until the screwdriver stops against end 62 of the window 63. This position of the retainer cup is illustrated in FIG. 9. In this rotated orientation, the apertures 53 and 53' in the ends of the driving member 40 and retainer cup 50 are misaligned, similar to the orientation shown in FIG. 6 preventing the control shaft 24 from being removed. When the locking plate 30 then is pulled outward, a tab 66 (see also FIG. 3) in the lower section of the locking plate enters a channel 58 in the periphery of the retainer cup 50 between the two longitudinal ridges 60 and 60'. Thus, when the locking plate 30 is pulled out, not only is the handle locked in the off position, but the retainer cup 50 is held in a position which captures the end of the control shaft 24. Therefore, the cabinet door 12 cannot be opened.

Figure 10:
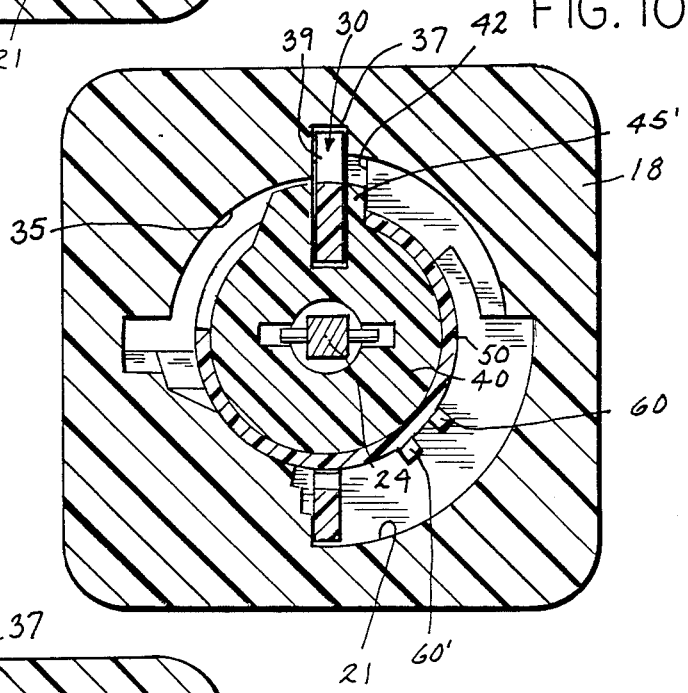

When the handle 16 is rotated so that its rectangular projection 27 is in the vertical orientation, at which the disconnect switch is on, the locking plate 30 lines up with the second groove 37 in the base 18 as shown in FIG. 10. In this orientation, the ear 38 on the locking plate 30 strikes the underside of arcuate base projection 35, preventing the plate from being pulled outward to lock the handle. Normally this is a desirable feature as the electricity can always be disconnected in the event of an emergency. However, there may be certain applications of the handle assembly 10 where the switch should be locked in the on position. This can be implemented by cutting off the ear 38 from the underside of the handle assembly 10 before it is mounted on the door 12. Once this has been done, the locking plate 30 can be partially extracted from the handle so that the lower portion 39 enters the second groove 37 preventing rotation of the handle 16.

In the locked on state, as well as the unlocked on state, the end of the control shaft 24 is captured by the retainer cup 50. However, if a screwdriver blade is inserted in the handle window 63, it can engage a notch in the retainer cup rim 64 (FIG. 2) and rotate the retainer cup 50 against the force of torsion spring 48 to release the control shaft 24. Thus, the door 12 can be opened by a tool when the switch is in the on position. However, unless one has a suitable tool and is aware of how to defeat the interlock feature, the door 12 cannot be opened in the on state of the switch.

Figure 11:
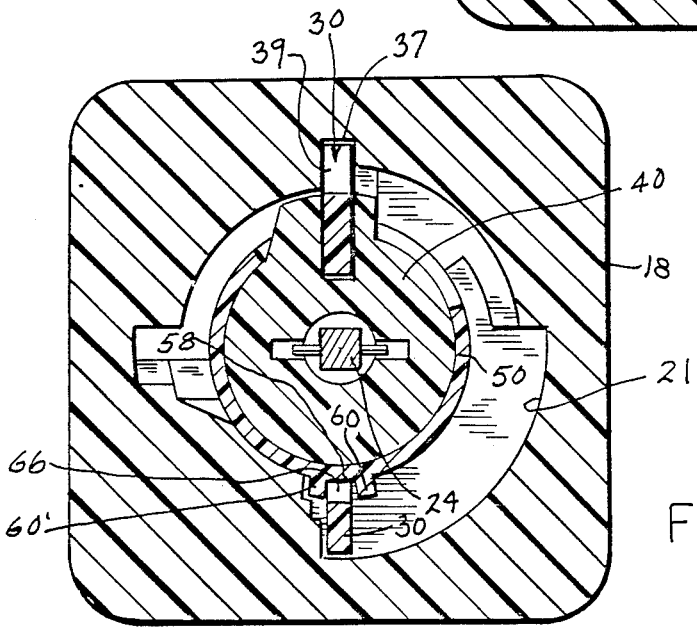

If the ability to open the cabinet 14 when the switch is in the locked on position is not desired, the handle assembly can be configured to enable this. First of all, the ear 38 on the locking plate 30 must be cut off to allow the handle assembly 10 to be locked in the on orientation. In addition, the handle window 63 must be enlarged by breaking away an end section 67. The end section 67 is a thinned region of the disc portion 26 of the handle 16 and has indentations defining its shape. The indentations make it easy to remove the end section 67 with a needle nose pliers. When window 63 is enlarged, another notch on the rim 64 of the retainer cup 50 is exposed. By placing a screwdriver blade in this newly exposed notch, the retainer cup can be rotated past the middle position, where its retainer cup's end aperture 53 is aligned with the end aperture 53' in the driving member 40, to another orientation where these apertures are again misaligned capturing the shaft 24. In this later orientation shown in FIG. 11, the channel 58 formed between the two ridges 60 and 60' on the periphery of the retainer cup 50 is lined up with the tab 66 of the locking plate 30. Now, in the on position when the locking plate is pulled outward, the lower portion 39 not only enters the second base groove 37, but tab 66 enters the channel 58 between the retainer cup ridges 60 and 60'. In this state, the driving member 40 and the retainer cup 50 are held in a position in which their apertures 53' and 53 are misaligned, thereby captivating the shaft 24. Thus, the handle assembly 10 is locked in the on position and the cabinet door 12 cannot be opened by inserting a screwdriver in window 63.

Figure 12:
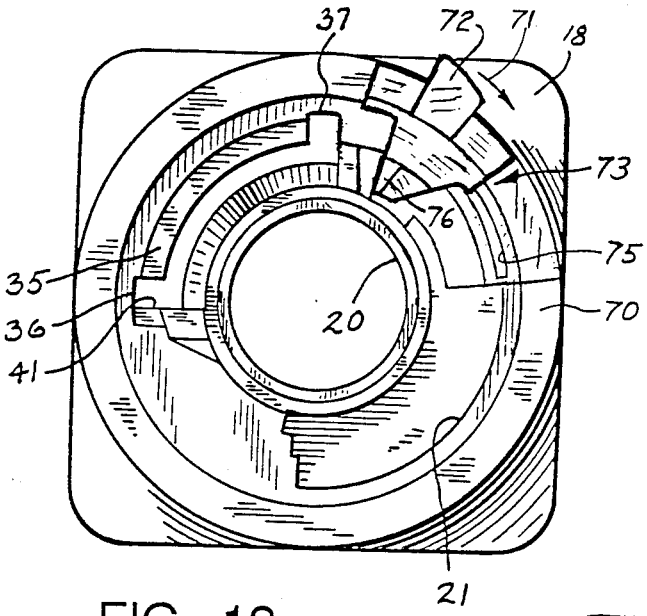
FIG. 12 is a plane view of the base of a second embodiment of the handle assembly.
Figure 13:
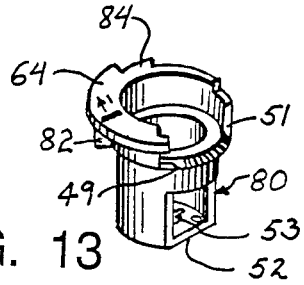
FIG. 13 is a perspective view of the retainer cup for the second embodiment.

In certain applications of the present operating handle assembly, it may be undesirable to open the electrical cabinet under any circumstances when the handle assembly is padlocked. FIGS. 12 and 13 respectively illustrate an alternative base 70 and a retainer cup 80 which can be substituted for base 18 and cup 50 in FIG. 2 to inhibit the ability to open the padlocked cabinet. In this second embodiment of the present invention, like handle assembly elements to those of the previously described embodiment have been designated with the same reference numerals.

With reference to FIG. 12, the alternative base 70 has a slide actuator 72 received in a cut out portion 73 in the inner surface of the base aperture 20. The slide actuator 72 has a projection 74 (visible only in FIGS. 14–17) which is received in an arcuate groove 75 in the base. Groove 75 acts to guide the actuator 72 in its movement around a segment of the circumference of the aperture 20 as indicated by arrow 71. A compression spring (not shown) biases the slide actuator counterclockwise into the position depicted in FIG. 12. The movement and function of the slide actuator 72 will be described in detail subsequently.

The alternative retainer cup 80 shown in FIG. 13 is similar to the retainer cup 50 in FIG. 2. However, the two longitudinal ridges 60 and 60' have been replaced by a single wider ear 82. The rim 64 of the retainer cup 80 has been extended for a greater distance around the lip of the cup and has a notched portion 84 at the end of the extension.

The base 70 and retainer cup 80 of the second embodiment are assembled with the other components illustrated in FIG. 2 to produce a handle assembly similar to that shown in FIG. 3. However, the differences in the base and retainer cup produce a different operation of this handle assembly.

Figure 14:
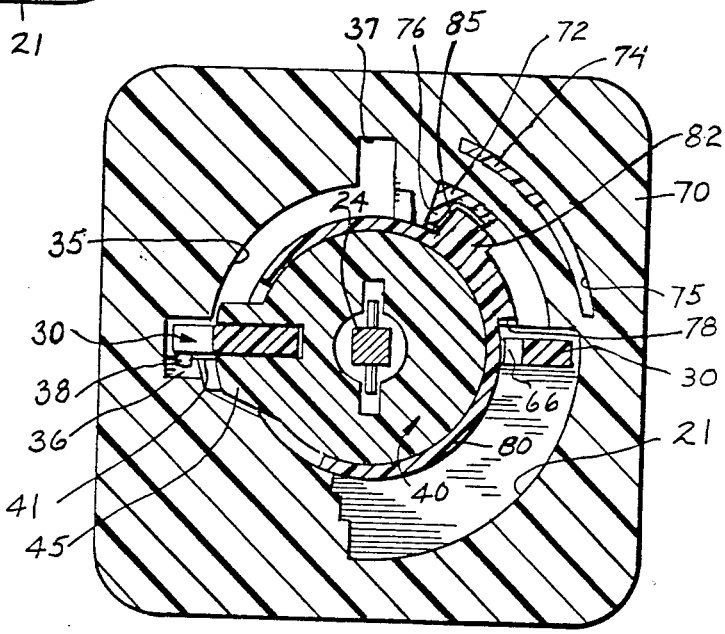
FIGS. 14–17 are cross-sectional views of the second embodiment of the operating handle assembly in different positions.

In the off position of the switch, the handle 16 is rotated into a fully horizontal position with the components oriented as illustrated in FIG. 14. In this orientation, the locking plate 30 is against the wall 41 of the first groove 36 in the base 70. The torsion spring 48 biases the surface 85 of the retainer cup ear 82 against a tab 76 on the slide actuator 72. As a result of the difference in the cut out portion 73 from the corresponding region of the original base 18, the spring 48 rotates the retainer cup 80 farther counterclockwise than the original cup 50 is rotated in FIG. 8. Therefore, in the horizontal off position of the handle 16, the apertures 53 and 53' in the retainer cup 80 and driving member 40 are misaligned similar to the relationship depicted in FIG. 6. This misalignment of the apertures captures the end of the shaft 24 within the handle assembly in the off position.

Figure 15:
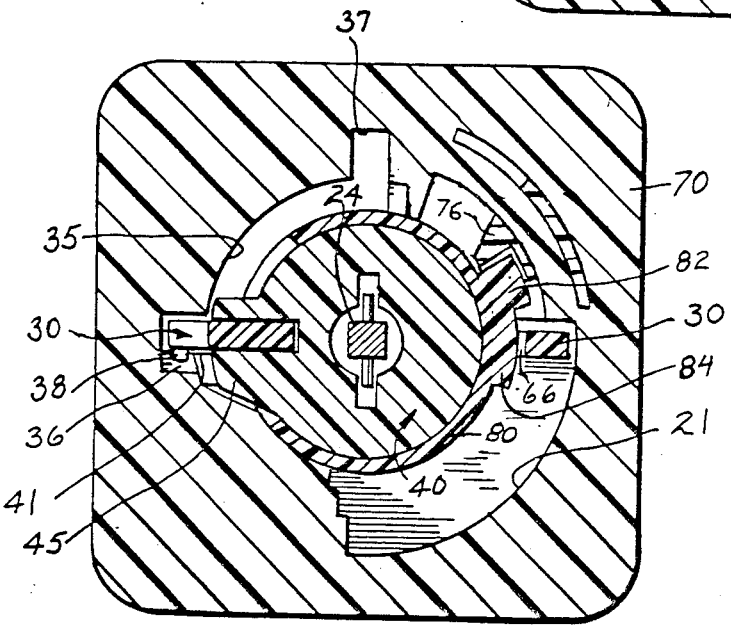

If the slide actuator 72 is moved clockwise around the base 70, its tab 76 will push the ear 82 of the retainer cup 80 rotating the retainer cup into a position where apertures 53 and 53' are aligned. This rotation is illustrated in FIG. 15 and the aligned apertures are depicted in FIG. 5. In this aligned orientation of the apertures, the switch shaft 24 can pass out of the handle assembly 10 as the door 12 opens.

In the off position of the handle 16 with the slide actuator released as shown in FIG. 14, the locking plate 30 can be pulled outward into the first groove 36 and a padlock can be inserted in aperture 32 (see FIG. 1). With the locking plate in the outward state, the end 78 of the retainer cup ear 82 will strike the tab 66 of the locking plate 30 if the cup is rotated clockwise, as evident from FIG. 14. Therefore, in the locked off position, the retainer cup 80 cannot be rotated into the position depicted in FIG. 15 at which the apertures 53 and 53' are aligned. This maintains the switch shaft 24 captured in the handle assembly 10 preventing the door 12 from being opened.

In the unlocked state once the retainer cup 80 has been rotated into the shaft release position shown in FIG. 15 to open the door, the notched portion 84 of the rim 64 extends over the tab 66 of the locking plate. This prevents the locking plate from being pulled outward when the handle assembly is in a position at which the door can be opened. Therefore, the handle assembly 10 can only be locked in the off state when the apertures 53 and 53' are misaligned and the door cannot be opened. Furthermore, when the handle assembly is locked "off", the door 12 cannot be opened unless the padlock is removed and the locking plate released.

Figure 16:
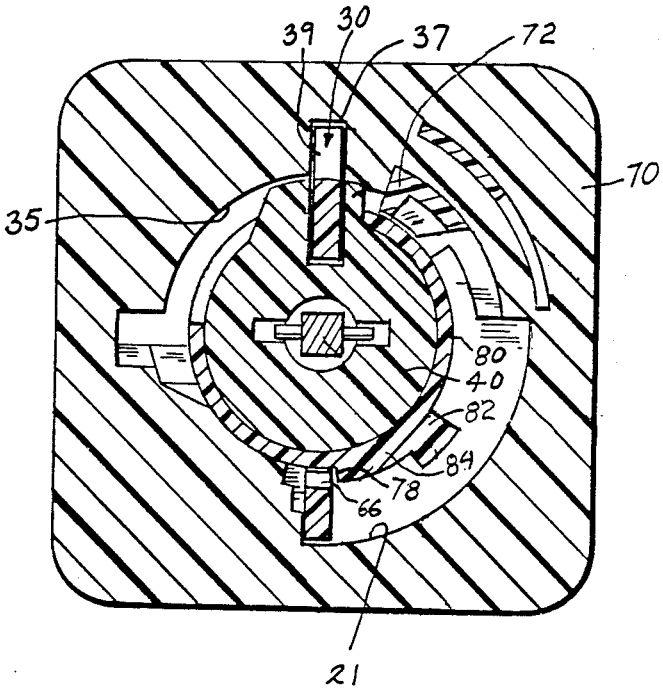
Figure 17:
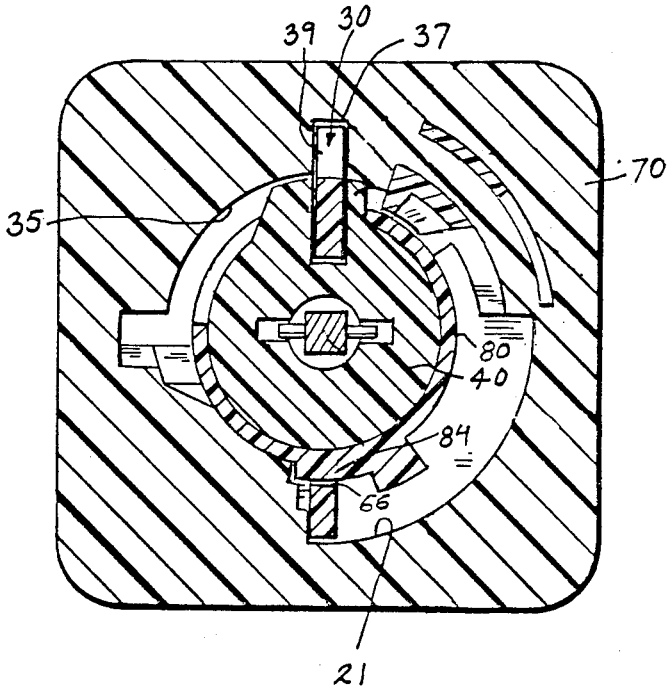

When the handle 16 is rotated into the vertical, or "on" position, the components of the handle assembly 10 are oriented as shown in FIG. 16. The apertures 53 and 53' in the retainer cup 80 and driving member 40, respectively, are now misaligned capturing the switch shaft 24 and preventing the door 12 from being opened. The ear 82 of the retainer cup 80 is rotated away from the slide actuator 72 so that operation of the actuator will not cause an alignment of the apertures 53 and 53'. However, should access to the interior of the cabinet 14 be desired when the switch is on, a screwdriver can be inserted in the window 63 of the handle 16 to rotate the retainer cup 80, as shown in FIG. 17 and release the shaft 24 from apertures 53 and 53'.

Referring again to FIG. 16, the locking plate 30 in the on position is aligned with the second groove 37 in base 16 and can be pulled outward into the groove to lock the handle assembly 10 in the on position. When the handle assembly is in this locked state, the tab 66 on the locking plate is raised to the level of the notched portion 84 of the retainer cup 80. This prevents a screwdriver, inserted in window 63 of the base, from rotating the retainer cup 80 to align apertures 53 and 53' and open the door 12.

Furthermore, when a screwdriver is used to rotate the retainer cup 80 to open the door, the notched portion 84 of the retainer cup rim 64 is above the tab 66 of the locking plate 30. This orientation shown in FIG. 17 prevents the locking plate from being pulled outward to lock the handle assembly in the on position when the apertures 53 and 53' for shaft 24 are aligned.

Therefore, the second embodiment of the handle assembly 10 does not allow the door 12 of the cabinet 14 to be opened when the handle assembly is locked by a padlock. This inhibiting the door from opening is provided regardless of whether the handle assembly is locked in the on or off state.

We claim:

1. An improved electrical switch apparatus including an enclosure having a door with an aperture therethrough, and including a shaft rotatable to operate the switch apparatus, the end portion of the shaft being aligned with the aperture when the door is closed, wherein the improvement comprises a handle assembly including:

a base member fastened to said door and having an aperture aligned with the door aperture, said base member having at least one groove therein;

a shaft driving member rotatably extending through the aperture in said base member and engaging the end portion of the shaft when the door is closed;

a retainer cup disposed around said driving member and rotatable thereabout, said retainer cup having a first orientation at which the shaft is held in engagement with said driving member and a second orientation at which the shaft can be disengaged from said driving member; and a locking plate slidably coupled to a slot in said driving member to engage said at least one groove in said base member to prevent rotation of said driving member with respect to said base member.

2. The apparatus as recited in claim 1 further comprising a handle coupled to said driving member.

3. The apparatus as recited in claim 1 wherein said locking plate includes means for engaging said retainer cup to prevent rotation thereof with respect to said driving member.

4. A handle assembly for operating an electrical apparatus which has a shaft, said assembly comprising:

a base member having an aperture therethrough and a surface with a groove;

means, rotatably abutting said base member, for rotating the shaft and having a first aperture for receiving an end portion of the shaft;

means for retaining the shaft within the first aperture of said means for rotating the shaft, said means for retaining having a second aperture for receiving the shaft, and having a first position at which the first and second apertures are substantially aligned and a second position at which the first and second apertures are misaligned to capture the end portion of the shaft;

means for preventing movement of said means for rotating with respect to said base member, having a first locked state at which the means for preventing movement engages the groove in said base member, and having released state at which the groove is not engaged enabling said means for rotating to be moved with respect to said base member;

means, engaged by the means for preventing movement, for holding the means for retaining in either the first or second position when the means for preventing movement is in the first locked state.

5. The handle assembly as recited in claim 4 wherein said base member includes a second groove engageable by said means for preventing movement to place the means for preventing movement in a second locked state.

6. The handle assembly as recited in claim 5 wherein the first and second apertures are misaligned in said second locked state.

7. The handle assembly as recited in claim 5 further including means for manually aligning the first and second apertures in said second locked state.

8. The handle assembly as recited in claim 5 wherein said means for holding also can be operated to prevent alignment of the first and second apertures in the second locked state.

9. The handle assembly as recited in claim 5 capable of being modified to enable the means for holding to lock the means for retaining in a position in which the first and second apertures are misaligned when said means for preventing movement is in the second locked state.

10. The handle assembly as recited in claim 4 wherein said means for retaining comprises a cup-like member extending into the aperture in said base.

11. The handle assembly as recited in claim 10 wherein said means for rotating the shaft includes a driving member having a cylindrical portion which nests within said cup-like member, and having a slotted portion.

12. The handle assembly as recited in claim 11 wherein said means for preventing movement comprises a locking member having a first portion within the slotted portion of said driving member, and having a second portion which in a locked state releasably engages the groove in said base member.

13. The handle assembly as recited in claim 12 wherein said locking member in said locked state also releasably engages said cup-like member to prevent the latter mentioned member from rotating with respect to said driving member.

14. A handle assembly for operating the shaft of an electrical apparatus, said assembly comprising:

a base having an aperture therethrough;

a cup-like member extending through said aperture and having a first aperture for receiving an end of the shaft;

a means for rotating the shaft extending into said cup-like member and having a second aperture for receiving the end of the shaft;

locking means coupled to said means for rotating for releasably engaging said base and said cup-like member;

said handle assembly having a first locked state wherein said locking means engages the base and said cup-like member to hold said means for rotating in a first position with respect to said base with the first and second apertures held in a misaligned relationship.

15. The handle assembly as recited in claim 14 having a second locked state wherein said locking means engages the base and said cup-like member to hold said means for rotating in the first position with the first and second apertures held in a substantially aligned relationship.

16. The handle assembly as recited in claim 15 having a third locked state in which said locking means engages said base and said means for rotating is held in a second position with respect to said base with the cup-like member being movable to substantially align or misalign the first and second apertures.

17. The handle assembly as recited in claim 16 having a fourth locked state in which said locking means engages said base and said cup-like member to hold the means for rotating in the second position with the first and second apertures held in a misaligned relationship.

18. The handle assembly as recited in claim 14 having another locked state in which said locking means engages said base and said cup-like member to hold the means for rotating in a second position with the first and second apertures held in a misaligned relationship.

19. A handle assembly for operating an electrical apparatus which has a shaft, said assembly comprising:

a base member having an aperture therethrough and a surface with a groove;

means, rotatably abutting said, base member, for rotating the shaft and having a first aperture for receiving the end portion of the shaft;

means for retaining the shaft within the first aperture of said means for rotating the shaft, said means for retaining having a second aperture, for receiving the shaft, and having a first position at which the first and second apertures are substantially aligned and a second position at which the first and second apertures are misaligned to capture the end portion of the shaft;

means for preventing movement of said means for rotating with respect to said base member, having a first locked state at which said means for preventing movement engages the groove in said base member, and having a released state at which the groove is not engaged enabling said means for rotating to be moved with respect to said base member;

means, engaged by the means for preventing movement, for holding the means for retaining in only the second position when the means for preventing movement is in the first locked state.

20. The handle assembly as recited in claim 19 wherein said base member includes a second groove engageable by said means for preventing movement to place the means for preventing movement in a second locked state.

21. The handle assembly as recited in claim 20 wherein the first and second apertures are misaligned in said second locked state.

22. The handle assembly as recited in claim 19 further including means for manually moving said means for retaining.

23. The handle assembly as recited in claim 19 wherein said means for retaining comprises a cup-like member extending into the aperture in said base.

24. The handle assembly as recited in claim 23 wherein said means for rotating the shaft includes a driving member having a cylindrical portion which nests within said cup-like member, and having a slotted portion.

25. The handle assembly as recited in claim 24 wherein said means for preventing movement comprises a locking member having a first portion within the slotted portion of said driving member, and having a second portion which in a locked state releasably engages the groove in said base member.

26. The handle assembly as recited in claim 25 wherein said locking member in said locked state also releasably engages said cup-like member to prevent the latter mentioned member from rotating with respect to said driving member.

* * * * *

UNITED STATES PATENT AND TRADEMARK OFFICE

CERTIFICATE OF CORRECTION

PATENT NO. : 4,851,621

DATED : July 25, 1989

INVENTOR(S) : Borchardt, Robert E. et al.

It is certified that error appears in the above-identified patent and that said Letters Patent is hereby corrected as shown below:

On the cover sheet add--Assignee: Allen-Bradley Company, Inc., Milwaukee, WI--.

Column 2, line 43, after "the" insert --operating--.

Column 8, line 66, after "having" insert --a--.

Column 10, line 22, delete the comma.

Signed and Sealed this

Thirty-first Day of July, 1990

*Attest:*

*Attesting Officer*

HARRY F. MANBECK, JR.

*Commissioner of Patents and Trademarks*